US008491755B2

(12) United States Patent
Silenius et al.

(10) Patent No.: US 8,491,755 B2
(45) Date of Patent: Jul. 23, 2013

(54) METHOD FOR MANUFACTURING PAPER AND BOARD

(75) Inventors: Petri Silenius, Lohja as. (FI); Risto Kekki, Kantvik (FI)

(73) Assignee: M-real Oyj, Espoo (FI)

( * ) Notice: Subject to any disclaimer, the term of this patent is extended or adjusted under 35 U.S.C. 154(b) by 207 days.

(21) Appl. No.: 10/532,085

(22) PCT Filed: Oct. 24, 2003

(86) PCT No.: PCT/FI03/00795

§ 371 (c)(1),
(2), (4) Date: Apr. 21, 2005

(87) PCT Pub. No.: WO2004/038100

PCT Pub. Date: May 6, 2004

(65) Prior Publication Data

US 2006/0060318 A1 Mar. 23, 2006

(30) Foreign Application Priority Data

Oct. 24, 2002 (FI) ..... 20021900

(51) Int. Cl.
*D21H 17/69* (2006.01)

(52) U.S. Cl.
USPC ..... 162/181.2; 162/135; 162/158; 162/181.1

(58) Field of Classification Search
None
See application file for complete search history.

(56) References Cited

U.S. PATENT DOCUMENTS 5,888,348 A * 3/1999 Hampl, Jr. ..... 162/139
6,156,118 A * 12/2000 Silenius ..... 106/501.1
6,251,222 B1 * 6/2001 Silenius et al. ..... 162/9
2001/0000063 A1 * 3/2001 Silenius et al. ..... 162/181.1
2002/0084050 A1 * 7/2002 Silenius et al. ..... 162/181.1
2003/0051837 A1 * 3/2003 Silenius ..... 162/141
2004/0168779 A1 * 9/2004 Silenius et al. ..... 162/124
2004/0168782 A1 * 9/2004 Silenius et al. ..... 162/181.1
2004/0173329 A1 * 9/2004 Silenius et al. ..... 162/135
2004/0244930 A1 * 12/2004 Silenius et al. ..... 162/158
2004/0256067 A1 * 12/2004 Leskela et al. ..... 162/142
2006/0183816 A1 * 8/2006 Gelman et al. ..... 523/201

FOREIGN PATENT DOCUMENTS

EP 930345 A1 * 7/1999
EP 0 935 020 A1 8/1999
WO 97/01670 A1 1/1997
WO 02/092909 A1 11/2002

OTHER PUBLICATIONS

Silenius, P. "Improving the Combinations of Critical Properties and Process Parameters of Printing and Writing Papers and Paperboards by New Paper-Filling Methods", Dissertation, Helsinki Univ of Tech, Dept Forest Prod, 2003,[online] Retrieved from the Internet [retr Feb. 21, 2012] <URL: http://lib.tkk.fi/Diss/2003/isbn9512262819/isbn9512262819.pdf>.*

Hubbe, M, "Porosity (Too permeable, Not permeable enough)" Department of Wood and Paper Science at North Carolina State University, Sep. 25, 2003, pp. 1-2, ,[online] Retrieved from the Internet [retr Feb. 21, 2012] <URL: http://www4.ncsu.edu/~hubbe/TShoot/G_Poros.htm>.*

* cited by examiner

*Primary Examiner* — Mark Halpern
*Assistant Examiner* — Dennis Cordray
(74) *Attorney, Agent, or Firm* — Kubovcik & Kubovcik

(57) ABSTRACT

The use of filler for the manufacture of paper and board products the air permeability of which does not substantially change as a function of the amount of filler, the filler being at least in part made up of cellulose or lignocellulose fibrils on which there have been deposited light-scattering material particles the proportion of which is 67-85%, preferably approx. 70-82%, of the weight of the filler.

7 Claims, 1 Drawing Sheet

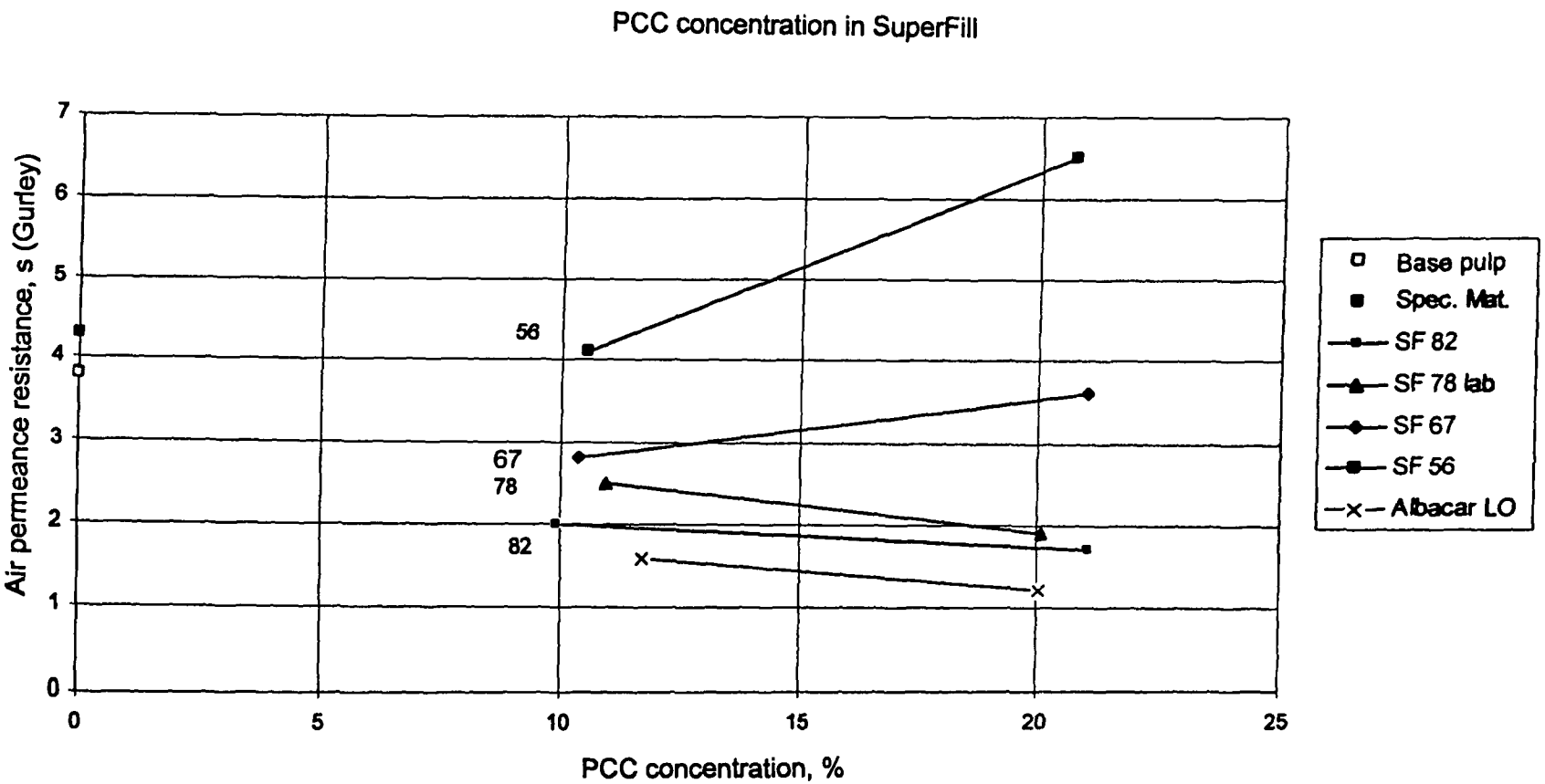
PCC concentration in SuperFill
Air permeance resistance, s (Gurley)
PCC concentration, %
Base pulp
Spec. Mat.
SF 82
SF 78 lab
SF 67
SF 56
Albacar LO
56
67
78
82
0
1
2
3
4
5
6
7
0
5
10
15
20
25

METHOD FOR MANUFACTURING PAPER AND BOARD

This application is a 371 of international application PCT/FI2003/000795, which claims priority based on Finnish patent application No. 20021900 filed Oct. 24, 2002, which is incorporated herein by reference.

FIELD OF THE INVENTION

The present invention relates to a method for manufacturing paper and board products having an air permeability which does not substantially change as a function of the amount of filler.

BACKGROUND OF THE INVENTION

The porosity and air permeability of paper and board are important quantities in terms of the final use properties of the product. These quantities are additionally important in, for example, the coating of paper. Furthermore, in certain areas of final use these quantities should be as far as possible constant.

Conventional fillers, i.e. mineral products in particulate form, have the disadvantage that they increase permeability and porosity of the base paper. Thus, an increase of the proportion of filler also increases the air permeability of the paper. Air permeability is in general characterized using the so-called Gurley number, which indicates the time (e.g. in seconds) in which a predetermined amount of air penetrates the layer examined. The greater the Gurley number, the higher the air permeability resistance and the lower the porosity of the paper. For this reason, when conventional fillers are used, it is necessary to alter the composition of the fiber material of the base paper by, for example, increasing the amount of fines, when it is desired to increase the proportion of filler and at the same time to maintain an air permeability/porosity of a constant magnitude. However, the increasing of the degree of beating of the pulp weakens the optical properties of the product being manufactured.

OBJECT OF THE INVENTION

It is an object of the present invention to eliminate the disadvantages associated with the state of the art and to provide a novel solution for the manufacture of paper having air permeability and porosity independent of the amount of filler.

SUMMARY OF THE INVENTION

The invention is based on the idea that the filler used for the base web for paper or board is at least in part, preferably mainly, a composite filler that comprises light-scattering mineral particles deposited on cellulose fibrils. It has been observed, unexpectedly, that a filler of this type gives, when incorporated into base paper or board, with a predetermined loading factor of mineral particles, an air permeability resistance the magnitude of which is substantially independent of the filler content. In other words, by a suitable selection of the loading factor of mineral particles in the filler there is obtained a product that can be added to the fiber web in the desired amount without a change in the air permeability and/or porosity of the web.

More specifically, the method according to the invention is mainly characterized by a filler which consists at least in part of cellulose or lignocellulose fibrils on which there have been deposited light-scattering material particles, the proportion of which is 67-85% of the weight of the filler.

The invention provides considerable advantages. Thus, the invention enables the air permeability resistance of paper and board products to be standardized in a more precise and controlled manner than previously, regardless of other factors. This is significant particularly in mills that manufacture papers of different filler contents for a certain final use area, in which the air permeability resistance and its constancy are of crucial importance. Such uses include envelope paper, for which it is desirable to increase the content of mineral filler in order to increase opacity, as well as various grades of board, in particular printing boards.

Furthermore, it has been observed that a composite filler made up of fibrils and mineral pigments gives base paper properties that are in terms of coatability better than those that can be achieved with the fillers at present available commercially. Since it surprisingly has turned out that with a composite filler used in the invention the formation of a fiber web can be significantly improved without deterioration of retention, a very uniform base for coating is produced by the present invention. The smoothness of the surface can also be improved. In addition, the fines-based carrier fraction of the filler seals the surface of the base paper so that the coating will not penetrate too much into the fiber network. For these reasons, even a small amount of coating provides good covering and good coating quality, whereby cost efficiency is improved.

Because the invention provides for a porosity which is independent of the filler amount, the composition of the coating pastes need not be altered even if the grade of the base paper or board changes. This is a significant advantage on an industrial-scale operation.

BRIEF DESCRIPTION OF DRAWINGS

The accompanying drawing shows a graphic representation of air penetration resistances of various fillers as a function of the mineral pigment content.

DETAILED EXPLANATION OF THE INVENTION

Next, the invention will be examined more closely with the aid of a detailed description. FI Patent Specification No. 100729 discloses a filler for use in papermaking, the filler comprising porous aggregates formed from calcium carbonate particles deposited on the surface of fines. According to the patent specification, this filler of a novel type is characterized in that the fines are made up of fine fibrils prepared by beating from cellulose fibers and/or mechanical pulp fibers. The size distribution of the fines fraction in mainly corresponds to wire screen fraction P100. This filler is referred to below also by the trade name "SuperFill".

On the basis of the said patent specification, the concentration of calcium carbonate in paper can be increased by using said filler, whereby the grammage of the paper can be lowered without changing the "other important" properties of the paper. The results in the publication are based on results measured from laboratory sheets by using standards SCAN-C 26:76 and respectively SCAN-M 5:76. No mention of the air permeability or porosity of paper or of the standardization of these can be found in the publication.

According to the present invention it has now unexpectedly been found that air permeability of paper can be standardized independently of other factors. We have noted that at a certain fibril proportion (in other words, calcium carbonate proportion) in the SuperFill filler, the air permeability of paper is not dependent on the filler content, as it is when conventional fillers are used. In general—when the operation is carried out in accordance with the invention—the air permeability of paper or board changes by a maximum of 10% when the amount of filler increases from approx. 10% by weight to 30% by weight, on the basis of the weight of the mineral component and the weight of the web.

It has further been observed in the invention that it is possible to use as a filler even other fillers that are at least in part made up of cellulose or lignocellulose fibrils on which light-scattering material particles have been deposited. These particles are typically inorganic salts precipitating in an aqueous phase, such as calcium carbonate, calcium sulfate, barium sulfate, and calcium oxalate.

The accompanying drawing shows the air permeability resistance of paper as a function of its filler content. The parameter is the calcium carbonate proportion of SuperFill filler. As will appear from the FIGURE, at low calcium carbonate proportions the air permeability resistance increases as the filler content increases, contrary to the situation with high calcium carbonate proportions. It can be concluded from the result that at certain calcium carbonate proportions the air permeability resistance is not dependent on the filler content. On the basis of the test results, this proportion is within the range of from 65 to % by weight, in particular approx. 67-78% by weight of calcium carbonate of the mass of SuperFill filler (fibers+mineral pigment). Below, this proportion is also called "loading factor".

Above the limit mentioned above, SuperFill filler behaves in the manner of a conventional mineral pulverous filler. In this case (at a loading factor of 80-90% by weight of mineral pigment, in particular at a maximum of approx. 85% by weight) it is, however, possible to exploit the capability of SuperFill to render paper or board very good mechanical properties. The density of paper can be improved by conventional methods, for example, by increasing the amount of fines, without deteriorating the strength properties.

The less a letter placed inside an envelope shows through the envelope, the better. In the present invention, the filler used provides a possibility to increase the proportion of filler in the base paper without a decrease of the air permeability resistance, as is the case when conventional fillers are used. However, the filler also for its part improves the opacity and formation of the base paper or board, as we have shown in our previous patent application 20010846.

Often, it is also desirable to improve the printability of an envelope to enable the senders brand names and trademarks and other graphic symbols to be printed on the envelope. The smoothness and coatability of the paper or board surface is in this case of great significance. With respect to meeting these criteria it is also advantageous to use the filler described in the present invention.

Envelope paper is additionally required to have good stiffness and mechanical strength. As noted above, the mechanical properties of paper and board can be improved with SuperFill and corresponding composite fillers.

When it is desired to manufacture a paper or board product having a predetermined air permeability of a constant magnitude, the following procedure can be followed:

- the degree of beating of the fines in the filler is selected,
- SuperFill fillers having different $CaCO_3$/fines ratios are prepared,
- test sheets are prepared,
- the properties are measured, and
- the $CaCO_3$/fines ratio that yields a constant air permeability at different filler contents is interpolated from the results.

On the basis of the procedure disclosed it is possible to select a suitable filler that will be used for filling paper or board in order to standardize its air permeability and/or porosity.

DESCRIPTION OF PREFERRED EMBODIMENTS

Below, the preparation of the filler and the fiber web is examined in greater detail:

Preparation of Filler

The filler used in the invention is based on fibrils obtained from chemical pulp. By chemical pulp is meant in this context a pulp that has been treated with cooking chemicals for the delignification of cellulose fibers. According to one preferred embodiment, the fibrils are obtained by beating a pulp prepared by the sulfate process or some other alkaline process. The invention is suited for the modification not only of fibrils obtained from chemical pulp but also those obtained from chemimechanical and mechanical pulps.

Typically the average thickness of cellulose or lignocellulose fibrils is smaller than 5 μm, usually smaller than 1 μm. The fibrils are characterized by one or both of the following criteria:

a. they correspond to a fraction passing a 50 (or preferably 100) mesh screen; and
b. their average thickness is 0.01-10 μm (preferably at maximum 5 μm, especially preferably at maximum 1 μm) and their average length is 10-1500 μm.

The source material for the fibrils, i.e. fines based on cellulose or other fibers, is fibrillated by beating it in a pulp refiner. The desired fraction may, when necessary, be separated by using a screen, but fines need not always be screened. Suitable fibril fractions include wire screen fractions P50-P400. Preferably refiners with grooved blades are used.

The light-scattering material particles in the filler are inorganic or organic salts that can be formed from their source materials by precipitation in an aqueous medium. Such compounds include calcium carbonate, calcium oxalate, calcium sulfate, barium sulfate, and mixtures thereof. The material particles are deposited on the fibrils. The amount of an inorganic salt compound in proportion to the fibril amount is approx. 0.0001-95% by weight, preferably approx. 0.1-90% by weight, in particular approx. 60-80% by weight, calculated from the amount of filler, and approx. 0.1-80% by weight, preferably approx. 0.5-50% by weight, of the paper.

Below, the invention is described in particular on the basis of the product according to FI Patent Specification No. 100729, but it is clear that the invention can be applied to the other products mentioned above by suitably altering the source materials of the light-scattering pigments.

The filler is prepared by depositing a mineral pigment on the surface of fine fibrils prepared from cellulose fibers and/or mechanical pulp fibers. For example the precipitation of calcium carbonate can be carried out by feeding into an aqueous slush of fibrils an aqueous calcium hydroxide mixture which possibly contains a solid calcium hydroxide, and a compound which contains carbonate ions and is at least partly dissolved in water. It is also possible to introduce into the aqueous phase carbon dioxide gas that, in the presence of calcium hydroxide, produces calcium carbonate. There form string-of-pearls-like calcium carbonate crystal aggregates which are held together by fibrils, i.e. fine strands, and in which the calcium carbonate particles are deposited onto the fine fibrils and attached to them. The fine fibrils together with calcium carbonate form string-of-pearls-like strands, which primarily resemble strings of pearls in a pile. In water (slush) the ratio of the effective volume of the aggregates to the pulp is very high compared with the corresponding ratio of conventional calcium carbonate used as filler. By "effective volume" is meant the volume required by the pigment.

The diameter of the calcium carbonate particles in the aggregates is approx. 0.1-5 μm, typically approx. 0.2-3 μm. The fibrils correspond in particular to wire screen fractions P50 (or P100)-P400. In the filler at least 80%, preferably up to 90%, of the precipitated light-scattering pigment particles are attached to fibrils.

According to the present invention, the loading factor of the pigment particles is at least 67% by weight (of the weight of the filler), preferably 70% by weight or greater, but below 85% by weight. Within this range, good dewatering is achieved in a paper or board machine and air permeability of a constant magnitude is achieved in the fiber web.

Preparation of the Fiber Web

The paper pulp is slushed in a manner known per se to a suitable consistency (typically to a solids content of approx. 0.1-1%) and is spread onto the wire. To the fiber slush there is added, preferably in the headbox of the paper or board machine, the above-mentioned filler, in general approx. 1-100% by weight of the weight of the fibers of the fiber pulp. In other words, the amount of filler may be even equal to—or greater than—the amount of the actual fiber pulp. In principle it is also possible to prepare a base web the fiber material of which in its entirety is made up of filler fibrils, and thus in general the present filler may constitute 1-100% by weight of the fiber material of the base web.

In a paper or board machine the fiber pulp is formed into a paper or board web. The fiber web is dried and coated, and electively after-treated, for example, by calendering. It is also possible to manufacture a multi-layer product that contains the present filler especially in the surface layers of the product. A multi layer web-forming technique can be applied to the manufacture of such products. Suitable pulp-feeding arrangements are described in, for example, FI Patent Specification No. 105 118 and EP Published Patent Application No. 824 157.

A multi-layer headbox is used most preferably together with a so-called gap former. In such an apparatus the slice discharge formed by the headbox is fed between two wires and water is removed from the pulp through the wires in two different directions. By the use of a gap former the fines can be caused to accumulate on the surfaces of the layer and the filler distribution will be "smiling" in shape. When a multi-layer headbox is used together with a gap former, the desired multi-layer structure is obtained simply by feeding the paper or board pulp in layers between the wires in the manner described above. By this technique it is also possible to manufacture products in which the layer thicknesses are smaller than in the conventional multi-layer technique.

In practice, the procedure may be that described in EP Published Patent Application No. 824 157, in which case the pulp is layered in the multi-layer headbox in such a manner that a composite filler is incorporated into the pulp streams directed to the surface layers. Additives, such as starch derivatives and possibly retention agents may also be incorporated into them. As we have shown in our parallel application, the retention of novel composite fillers is, however, so high that it is possible by using them to achieve a high retention without separate retention agents; this improves the formation of the surface layers. The pulp streams are directed as two, three or more streams, separated from each other by, for example, plastic separation sheets, to the slice lip where they are combined into one layered pulp flow. From the lip the pulp is fed to a gap formed by, for example, a gap former, from where it is directed past the wire dewatering devices to the press section of the paper machine. From the press section the pulp is directed thereafter to the dryer section, where it is dried in a manner known per se.

The coating can be carried out as a single coating or a double coating, in which case coating pastes can be used as single-coating paste and as so-called pre-coating and surface-coating pastes. Triple coatings are also possible. In general, the coating mixture according to the invention contains 10-100 parts by weight of at least one pigment or pigment mixture, 0.1-30 parts by weight of at least one bonding agent, and 1-10 parts by weight of other additives known per se. Some examples of pigments that can be mentioned are precipitated calcium carbonate, ground calcium carbonate, calcium sulfate, calcium oxalate, aluminum silicate, kaolin (hydrous aluminum silicate), aluminum hydroxide, magnesium silicate, talc (hydrous magnesium silicate), titanium dioxide and barium sulfate, as well as mixtures of these. Synthetic pigments are also possible. Of the above-mentioned pigments, the principal pigments are kaolin, calcium carbonate, precipitated calcium carbonate, and gypsum, which usually constitute over 50% of the dry matter of the coating mixture. Calcined kaolin, titanium dioxide, satin white, aluminum hydroxide, sodium silicoaluminate, and plastic pigments are additional pigments, and their amounts are usually below 25% of the dry matter of the mixture. Examples of special pigments include special kinds of kaolins and calcium carbonates, as well as barium sulfate and zinc oxide.

The coating mixture can be applied to the material web in a manner known per se. The process according to the invention for the coating of paper and/or board can be carried out using a conventional coating apparatus, i.e. by blade coating, or using film coating or JET application.

During coating, a coating layer having a grammage of 5-30 $g/m^2$ is formed on at least one of the paper web surfaces, preferably on both surfaces. The uncoated side may be treated by, for example, surface sizing.

By means of the invention it is possible to produce coated and electively also calendered cellulose-containing material webs having excellent printabilility properties, a good smoothness, and a high opacity and brightness. By "cellulose-containing material" is meant here in general paper or board or a corresponding cellulose-containing material that is derived from a lignocellulose-containing raw material, in particular wood or annual or perennial plants. The said material may be wood-containing or wood-free, and it can be prepared from mechanical, semimechanical (chemimechanical) or chemical pulp. The chemical pulp and the mechanical pulp may be bleached or unbleached. The material may also include recycled fibers, in particular recycled paper or recycled board. The grammage of the material web typically ranges from 35-500 $g/m^2$, in particular approx. from 50-450 $g/m^2$.

In general, the grammage of the base paper is 20-250 $g/m^2$, preferably 30-80 $g/m^2$. By coating a base paper of this type, having a grammage of approx. 50-79 $g/m^2$, with a coating of 2-20 $g/m^2$/side and by calendering the paper there is obtained a product having a grammage of 50-110 $g/m^2$, a brightness of at least 90%, and an opacity of at least 90%.

The proportion of the present filler in the base web may be approx. 5-50% by weight, typically approx. 10-30% by weight, of the weight of the base web.

The following non-limiting example illustrates the invention.

The measuring results indicated in the examples for the properties of paper were determined using the following standard methods:

Surface roughness: SCAN-P76:95

Air permeability resistance: SCAN-M8, P19

Example

Preparation of Handsheets by Using Different Fillers

In the test series, handsheets were made using a normal sheet mold and different fillers. The targeted grammage for the sheets was 62 g/m$^2$, with two different filler concentrations, 10 and 20%. The fillers used were a commercial PCC grade, Albacar LO, and four different SuperFill fillers. In these SuperFill fillers the PCC concentrations were 56, 67, 78, and 82%.

The SuperFill filler was prepared according to Example 1 of FI Patent Specification No. 100729 by suitably varying the amounts of the source materials.

The results are shown in the accompanying FIGURE.

It was observed that the completed SuperFill sheets were denser than the PCC sheets. In addition, the SuperFill sheets became even denser as the PCC concentration in the sheet increased.

The ability of SuperFill to generate more closed structure increases when a shift is made to SuperFill grades having lower PCC contents.

As is evident from the example, the use of fillers with loading factors of 67-82% yields a surface having a constant porosity, in which case the coating of papers or boards without changing the composition of the coating paste is possible regardless of the PCC concentration.

The invention claimed is:

1. A method for controlling air permeability in paper and board products such that the air permeability resistance of the paper and board products does not change more than 10% when the amount of a filler consisting at least in part of cellulose or lignocellulose fibrils on which there have been deposited precipitated calcium carbonate particles is increased from 10% by weight to 20% by weight, on the basis of the weight of the precipitated calcium carbonate component of the filler and the weight of the paper and board products, comprising adding to a fiber slush to be formed into the paper and board products, 10% by weight to 20% by weight of the filler consisting at least in part of cellulose or lignocellulose fibrils on which there have been deposited precipitated calcium carbonate particles, the proportion of the deposited precipitated calcium carbonate particles being between 70-85% of the weight of the filler, on the basis of the weight of the precipitated calcium carbonate component of the filler and the weight of the paper and board products.

2. The method according to claim 1, characterized in that the filler comprises cellulose or lignocellulose fibrils prepared from plant fibers by beating and screening, the average thickness of the fibrils being less than 5 μm.

3. The method according to claim 1, characterized in that the precipitated calcium carbonate particles are deposited on fibrils corresponding to a fraction that passes a 50-mesh screen and/or that have an average thickness of 0.1-10 μm and an average length of 10-1500 μm.

4. The method according to claim 1, characterized in that the paper and board products comprise a coating layer with a grammage of 5-30 g/m$^2$/side.

5. The method according to claim 1, characterized in that the paper and board products are envelope paper.

6. The method according to claim 1, wherein the envelope paper is coated envelope paper.

7. The method according to claim 6, characterized in that the coated envelope paper comprises a coating layer with a grammage of 5-30 g/m$^2$/side.

* * * * *